US008864278B2

(12) United States Patent
Donahue et al.

(10) Patent No.: US 8,864,278 B2
(45) **Date of Patent: *Oct. 21, 2014**

(54) DETECTING POTENTIAL COLLISION DAMAGE TO PRINTHEAD

(75) Inventors: Frederick Allen Donahue, Walworth, NY (US); David Scott Uerz, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 251 days.

This patent is subject to a terminal disclaimer.

(21) Appl. No.: 13/404,103

(22) Filed: Feb. 24, 2012

(65) Prior Publication Data

US 2013/0222446 A1 Aug. 29, 2013

(51) Int. Cl.
*B41J 29/393* (2006.01)

(52) U.S. Cl.
USPC ..... 347/19; 347/218; 347/16

(58) Field of Classification Search
USPC ..... 347/5, 9, 16, 19, 218
See application file for complete search history.

(56) References Cited

U.S. PATENT DOCUMENTS

| | | | | |
|---|---|---|---|---|
| 6,206,499 | B1 | 3/2001 | Iijima et al. | |
| 7,350,902 | B2 | 4/2008 | Dietl et al. | |
| 7,753,371 | B2 | 7/2010 | Gudaitis et al. | |
| 7,800,089 | B2 | 9/2010 | Burke et al. | |
| 7,862,147 | B2 | 1/2011 | Ciminelli et al. | |
| 2004/0233244 | A1* | 11/2004 | Elgee et al. | 347/19 |
| 2011/0242257 | A1* | 10/2011 | Takami et al. | 347/218 |

* cited by examiner

*Primary Examiner* — Lam S Nguyen
(74) *Attorney, Agent, or Firm* — Peyton C. Watkins

(57) ABSTRACT

A method of printing on a recording medium using a printhead having a printhead face that includes an array of marking elements, the method includes advancing the recording medium along a medium advance direction toward a printing region; detecting with a sensor whether a portion of the recording medium is positioned such that it would be in a collision path with the printhead face if the recording medium is advanced into the printing region; and advancing the recording medium into the printing region for printing if it is detected that the recording medium would not be in a collision path with the printhead face.

14 Claims, 8 Drawing Sheets

DETECTING POTENTIAL COLLISION DAMAGE TO PRINTHEAD

CROSS REFERENCE TO RELATED APPLICATION

Reference is made to commonly assigned, co-pending U.S. patent application Ser. No. 13/404,082, filed concurrently herewith, entitled "Sensor for Averting Potential Printhead Damage" by Frederick Donahue and David Uerz, the disclosure of which is herein incorporated by reference.

FIELD OF THE INVENTION

The present invention relates generally to sensing of the position of a recording medium relative to a printhead in a printer and more particularly to detection of potential collisions in order to avoid damage.

BACKGROUND OF THE INVENTION

Many types of printing systems include one or more printheads that have arrays of marking elements that are controlled to make marks of particular sizes, colors, and the like in particular locations on the recording medium in order to print the desired image. In some types of printing systems, the array of marking elements extends across the width, and the image can be printed one line at a time. However, the cost of a printhead that includes a page-width array of marking elements is too high for some types of printing applications so a carriage printing architecture is used instead.

In a carriage printing system (whether for desktop printers, large area plotters, and the like), the printhead or printheads are mounted on a carriage that is moved past the recording medium in a carriage scan direction as the marking elements are actuated to make a swath of dots. At the end of the swath, the carriage is stopped; printing is temporarily halted, and the recording medium is advanced. Then another swath is printed so that the image is formed swath by swath. In a carriage printer, the marking element arrays are typically disposed on a printhead face along an array direction that is substantially parallel to the media advance direction, and substantially perpendicular to the carriage scan direction.

In some types of printers, such as inkjet printers, the face of the printhead die containing the array of marking element array is positioned near the recording medium in order to provide improved print quality. Close positioning of the printhead face to the recording medium keeps the printed dots close to their intended locations even for angularly misdirected jets.

In order to provide the capability of printing across the entire width of the recording medium, and also to permit space for the carriage to decelerate and stop before changing directions to print the next swath, typically the carriage moves the printhead beyond the side edges of the recording medium. Generally the position of the recording medium relative to the printhead face is fairly well controlled. However, occasionally a sheet of recording medium can have a dog-eared edge, a fold close to a corner that causes the corner to bend upwardly or downwardly. Also occasionally multiple sheets of recording medium can be inadvertently fed at the same time which sometimes causes paper jamming and folding of the recording medium in accordion fashion. In such situations, the close proximity of the printhead face to the position of the recording medium can result in the recording medium striking the face of the printhead as the carriage moves the printhead past the edge of the recording medium. For printhead faces made of a material that is fragile or brittle, such strikes can cause damage to the printhead, which requires replacement of the printhead.

U.S. Pat. No. 6,206,499 describes a head cover that overlaps the sides of the edges of the printhead die in order to prevent the nozzle plate from becoming damaged due to "paper stacking." U.S. Pat. No. 7,862,147 describes providing an inclined surface that is positioned proximate to but not overlapping the edge of the printhead die, such that the recording media in the path of the oncoming printhead strikes the inclined surface and is deflected to avoid collisions with the fragile face of the printhead die. Although such a configuration reduces the occurrence of damaging collisions, it does not entirely eliminate the possibility of such collisions.

Consequently, a need exists for a way of detecting potential collisions between the recording medium and fragile portions of the printhead so that appropriate measures can be taken to avoid such collisions.

SUMMARY OF THE INVENTION

The present invention is directed to overcoming one or more of the problems set forth above. Briefly summarized, according to one aspect of the invention, the invention resides in a method of printing on a recording medium using a printhead having a printhead face that includes an array of marking elements, the method includes advancing the recording medium along a medium advance direction toward a printing region; detecting with a sensor whether a portion of the recording medium is positioned such that it would be in a collision path with the printhead face if the recording medium is advanced into the printing region; and advancing the recording medium into the printing region for printing if it is detected that the recording medium would not be in a collision path with the printhead face.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 1:
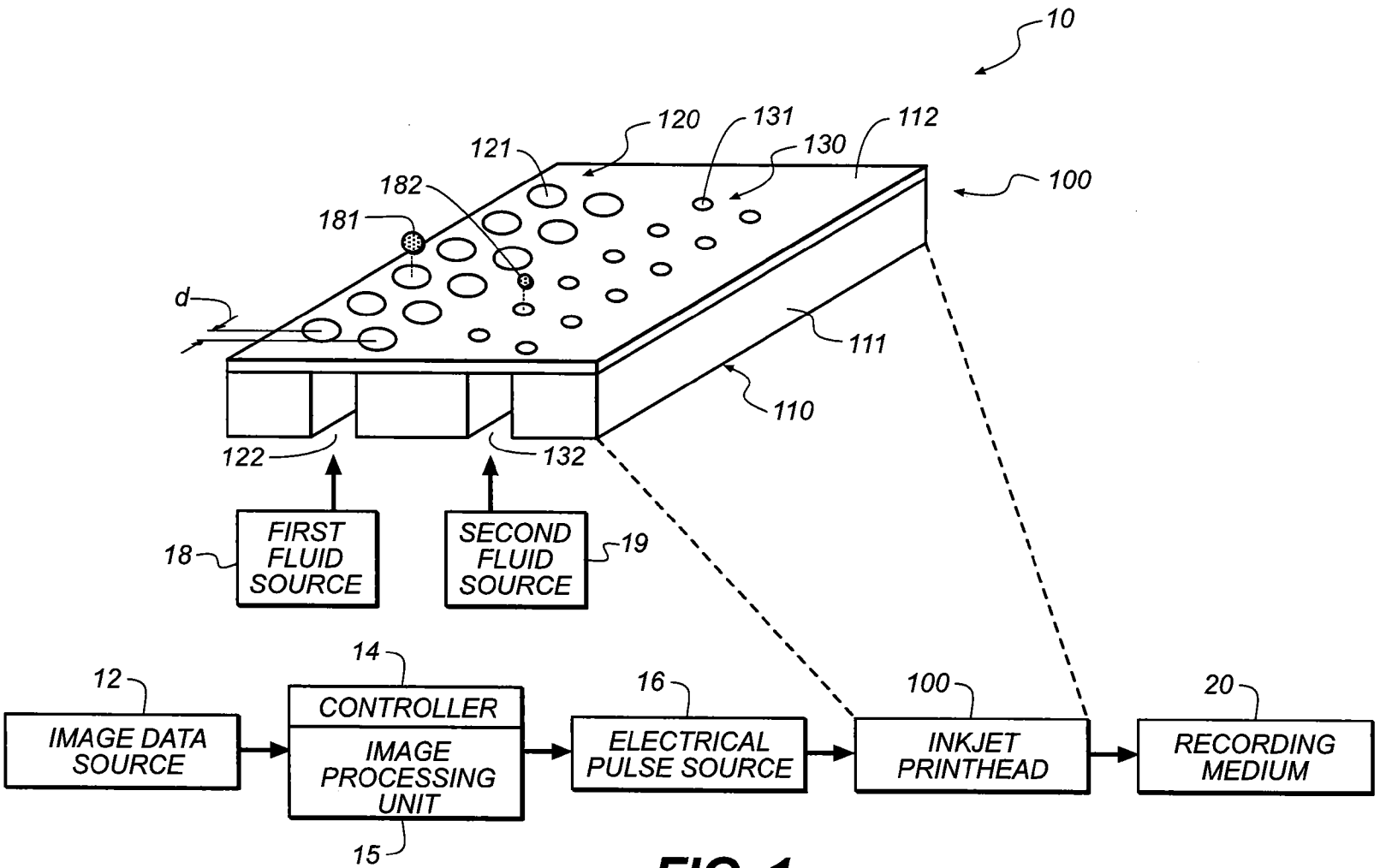
FIG. 1 schematically shows an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. The system includes an image data source 12 which provides signals that are interpreted by a controller 14 as commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

Figure 2:
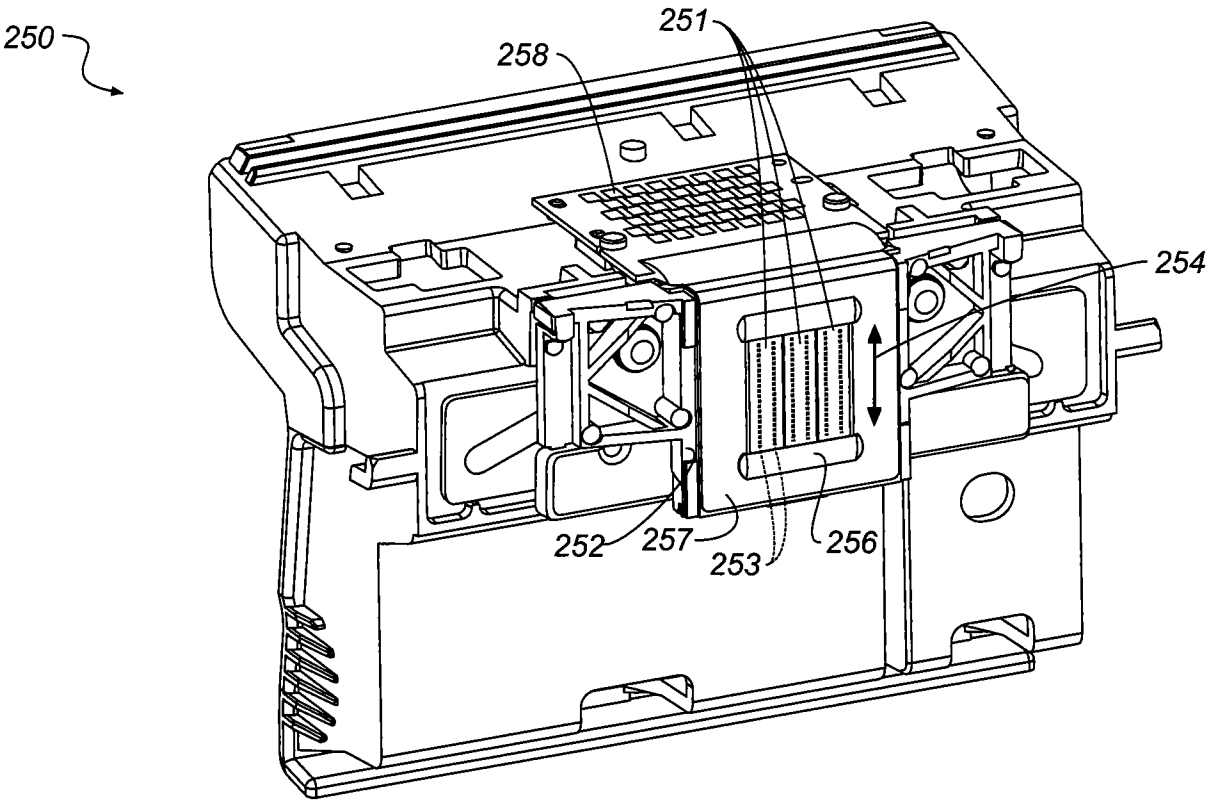
FIG. 2 shows a bottom perspective of a portion of a printhead.

In the example shown in FIG. 1, there are two nozzle arrays 120, 130 provided on a nozzle face 112 formed on a substrate 111 of printhead die 110. A face such as nozzle face 112 that contains the marking elements of a printhead for marking on a recording medium 20 can be more generically called the printhead face 112. Nozzles 121 in the first nozzle array 120 have a larger opening area than nozzles 131 in the second nozzle array 130. Nozzle arrays 120 and 130 extend along array direction 254 (FIG. 2). In this example, each of the two nozzle arrays 120 and 130 has two staggered rows of nozzles 121 and 131, each row having a nozzle density of 600 per inch. The effective nozzle density in each array is 1200 per inch. If pixels on the recording medium 20 were sequentially numbered along the paper advance direction, the nozzles 121, 131 from one row of the nozzle array 120, 130 would print the odd numbered pixels while the nozzles 121, 131 from the other row of the nozzle array 120, 130 would print the even numbered pixels.

In fluid communication with each nozzle array 120, 130 is a corresponding ink delivery pathway 122, 132. Ink delivery pathway 122 is in fluid communication with nozzle array 120, and ink delivery pathway 132 is in fluid communication with nozzle array 130. Portions of fluid delivery pathways 122 and 132 are shown in FIG. 1 as openings through printhead die substrate 111.

One or more printhead die 110 will be included in inkjet printhead 100, but only one printhead die 110 is shown in FIG. 1. The printhead die 110 are arranged on a mounting support as discussed below relative to FIG. 2. In FIG. 1, a first ink source 18 supplies ink to first nozzle array 120 via ink delivery pathway 122, and a second ink source 19 supplies ink to second nozzle array 130 via ink delivery pathway 132. Although distinct ink sources 18 and 19 are shown, in some applications it can be beneficial to have a single ink source supplying ink to nozzle arrays 120 and 130 via ink delivery pathways 122 and 132 respectively. Also, in some embodiments, fewer than two or more than two nozzle arrays 120, 130 can be included on printhead die 110. In some embodiments, all nozzles 121, 131 on a printhead die 110 can be the same size, rather than having multiple sized nozzles 121, 131 on the printhead die 110.

The drop forming mechanisms associated with the nozzles 121, 131 are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bilayer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on the recording medium 20.

FIG. 2 shows a perspective of a portion of a printhead 250, which is an example of an inkjet printhead 100 (FIG. 1). Printhead 250 includes three printhead die 251 (similar to printhead die 110), each printhead die 251 containing two nozzle arrays 253 formed on the nozzle face 112, so that printhead 250 contains six nozzle arrays 253 altogether. The six nozzle arrays 253 in this example can be each connected to separate ink sources (not shown in FIG. 2), such as cyan, magenta, yellow, text black, photo black, and a colorless protective printing fluid.

The three printhead die 251 are mounted on a mounting substrate 252 such that each of the six nozzle arrays 253 is disposed along array direction 254. The length of each nozzle array 253 along array direction 254 is typically on the order of 1 inch or less. Typical lengths of recording media are 6 inches for photographic prints (4 inches by 6 inches), or 11 inches for 8.5 by 11 inch paper. Thus, in order to print the full image, a number of swaths are successively printed while moving printhead 250 across the recording medium 20. Following the printing of a swath, the recording medium 20 is advanced.

Also shown in FIG. 2 is a flex circuit 257 to which the printhead die 251 are electrically interconnected, for example by wire bonding or TAB bonding. The interconnections are covered by an encapsulant 256 to protect them. Flex circuit 257 bends around the side of printhead 250 and connects to a connector board 258. When printhead 250 is mounted into a holding receptacle 236 of a carriage 200 (see FIGS. 3 and 6), connector board 258 is electrically connected to a connector 234 on the carriage 200 so that electrical signals can be transmitted to the printhead die 251.

Figure 3:
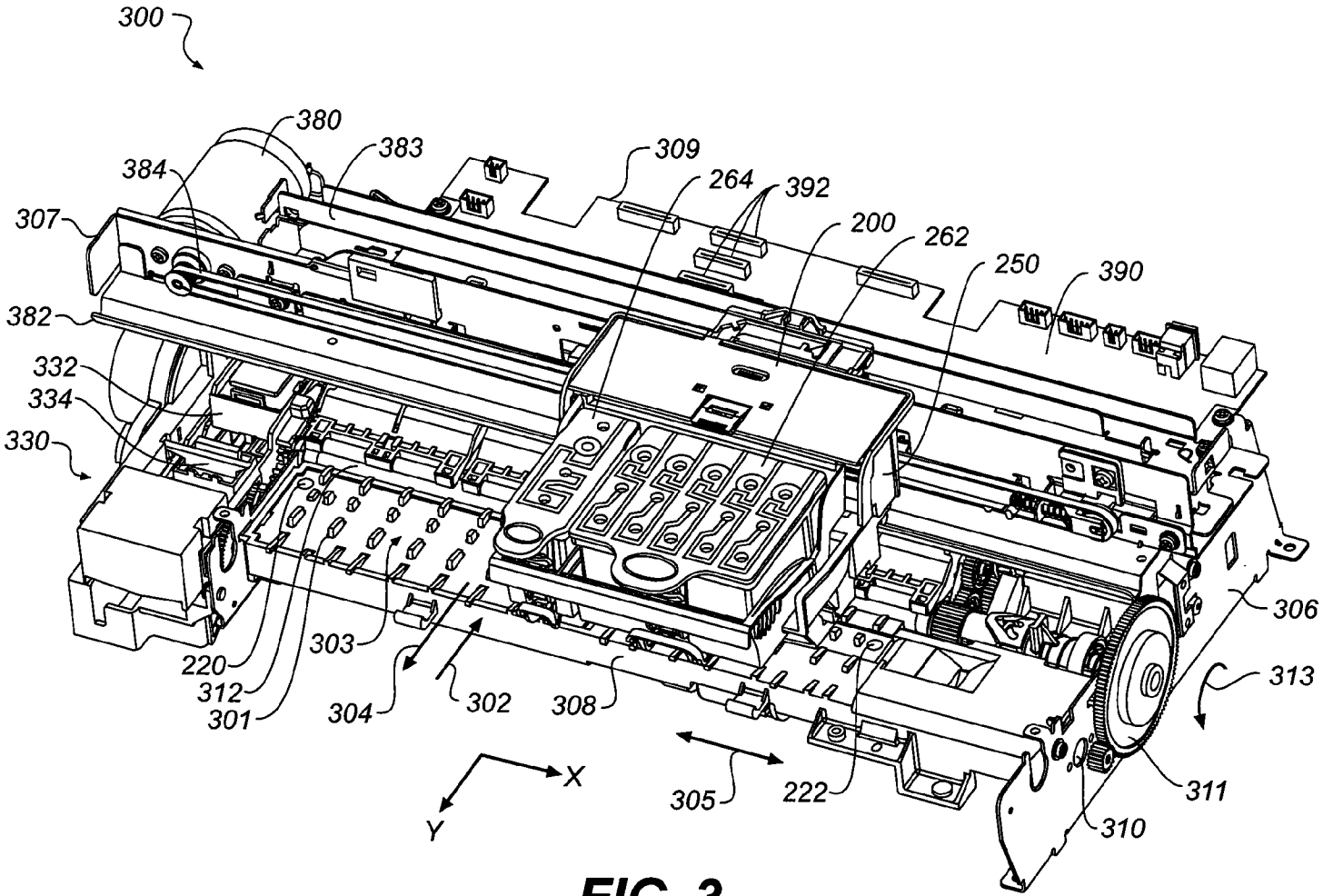
FIG. 3 is a perspective of a portion of a carriage printer.

FIG. 3 shows a portion of a carriage printer. Some of the parts of the printer have been hidden in the view shown in FIG. 3 so that other parts can be more clearly seen. Printer chassis 300 has a printing region 303 across which a carriage 200 is moved back and forth in carriage scan direction 305 along the X axis between a right side 306 and a left side 307 of printer chassis 300 while printing. A platen 301 (which optionally includes ribs) supports recording medium 20 (see FIG. 1) in printing region 303. A carriage motor 380 moves a belt 384 to move the carriage 200 back and forth across the printing region 303 along a carriage guide rail 382. Carriage position is monitored by the controller 14 (see FIG. 1) relative to a linear encoder 383. Printhead 250 is mounted in the carriage 200, and ink supplies 262 and 264 are mounted in the printhead 250. The mounting orientation of the printhead 250 is rotated relative to the view in FIG. 2, so that the printhead die 251 are located at the bottom side of printhead 250, the droplets of ink are ejected downward onto the recording medium 20 in printing region 303 in the view of FIG. 3. Ink supply 262, in this example, contains five ink sources cyan, magenta, yellow, photo black, and colorless protective fluid, while ink supply 264 contains the ink source for text black.

Paper, or other recording medium 20 (sometimes generically referred to as paper herein) is loaded along paper load entry direction 302 toward the front 308 of the printer chassis 300. A variety of rollers are used to advance the recording medium 20 through the printer, as shown schematically in the side view of FIG. 4. In this example, a pickup roller 320 moves a top sheet 371 of a stack 370 of paper or other recording medium 20 in an input region in the direction of arrow 302. A turn roller 322 toward the rear 309 of the printer chassis 300 acts to move the paper around a C-shaped path (in cooperation with a curved rear wall surface) so that the paper continues to advance along media advance direction 304 from the rear 309 of the printer. The paper is then moved by a feed roller 312 and idler roller(s) 323 to advance along the Y axis into and across printing region 303, and from there to a discharge roller 324 and star wheel(s) 325 so that printed paper exits along direction 304 to an output region (not shown). Feed roller 312 includes a feed roller shaft along its axis, and feed roller gear 311 is mounted on the feed roller shaft. Feed roller 312 can include a separate roller mounted on feed roller shaft, or can include of a thin high friction coating. Feed roller 312 is located near printing region 303 and is upstream of printing region 303.

Referring to FIG. 3, the motor that powers the paper advance rollers is not shown, but the hole 310 at the right side 306 of the printer chassis 300 is where the motor gear (not shown) protrudes through in order to engage feed roller gear 311, as well as the gear for the discharge roller (not shown). For normal paper pick-up and feeding, it is desired that all rollers rotate in forward direction 313. The motor that powers the paper advance rollers is typically reversible, so that at least some of the rollers, such as feed roller 312 can be rotated in the forward direction to advance the recording medium 20 toward printing region 303 and alternatively in a reverse direction opposite forward direction 313 to move the recording medium (e.g. sheet 371) away from printing region 303 and toward the input region represented by stack of media 370.

Toward the left side 307 in the example of FIG. 3 is a maintenance station 330, which typically includes a cap 332 and a wiper 334. Toward the rear 309 of the printer in this example is located an electronics board 390, which contains cable connectors 392 for communicating via cables (not shown) to the printhead carriage 200 and from there to the printhead 250 via connector 236 (FIG. 6) and connector board 258 (FIG. 2). Also on the electronics board 390 are typically mounted motor controllers for the carriage motor 380 and for the paper advance motor, a processor and/or other control electronics for controlling the printing process (shown schematically as controller 14 and image processing unit 15 in FIG. 1), and an optional connector for a cable to a host computer.

Figure 4:
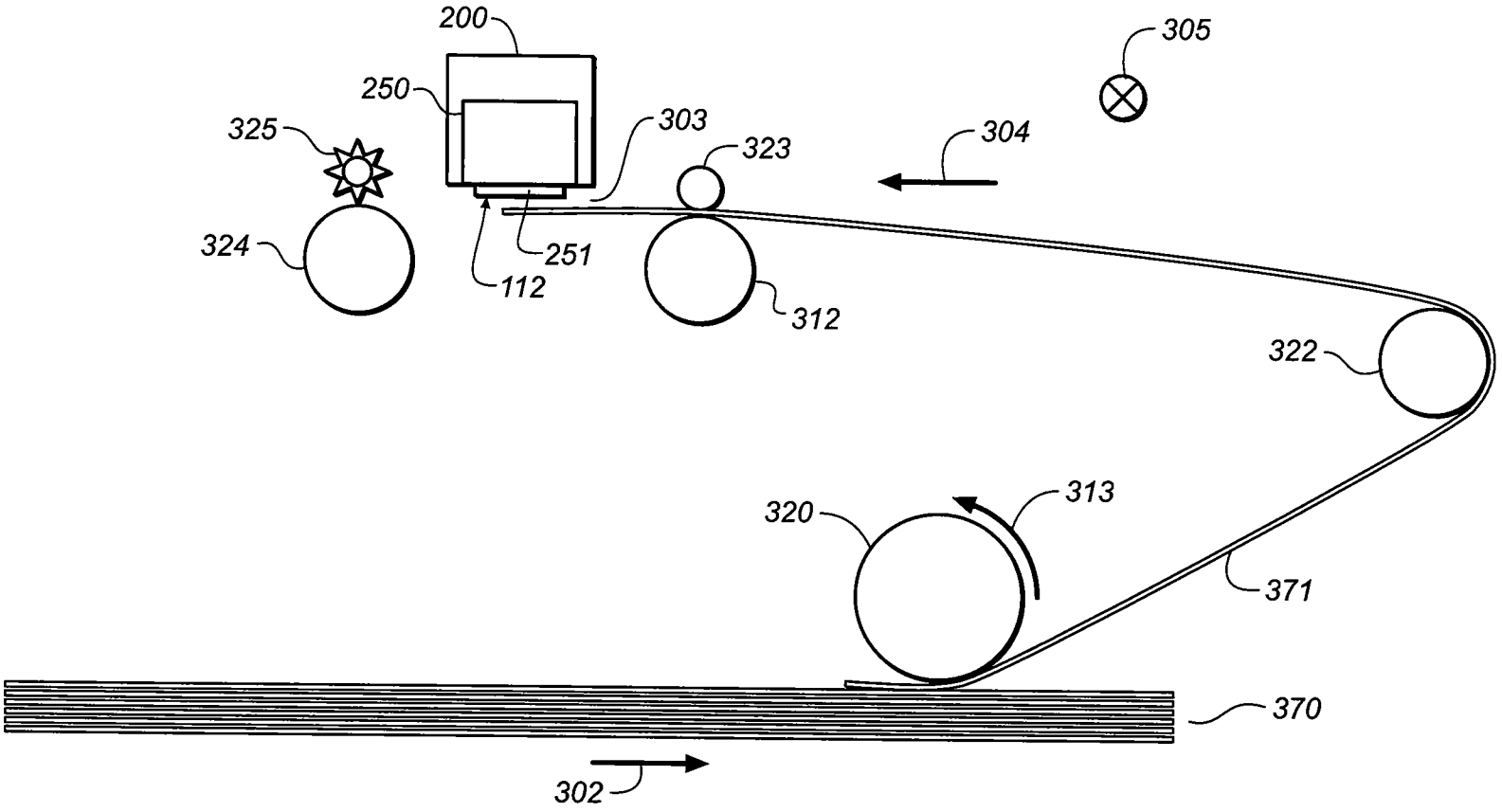
FIG. 4 is a schematic side view of a paper path in a carriage printer.

The carriage 200 is moved back and forth along carriage scan direction 305 (into and out of the plane of FIG. 4). In order to permit the nozzles to print the entire region of the paper, and then slow down the carriage 200 to a stop prior to printing the next swath, the printhead die 251 typically travel beyond the side edges of sheet 371 of paper. In order to provide good print quality, the printhead 250 is positioned such that nozzle face 112 of printhead die 251 is somewhat close to sheet 371 of paper in printing region 303. Due to manufacturing defects or other asymmetries, for example, some jets can be angularly misdirected. By positioning nozzle face 112 of printhead die 251 nominally within about 1.5 mm of sheet 371 in printing region 303, it is found that misdirected jets do not deviate too far from their intended positions so that the corresponding printed dots land in approximately the correct positions on sheet 371.

Figure 5:
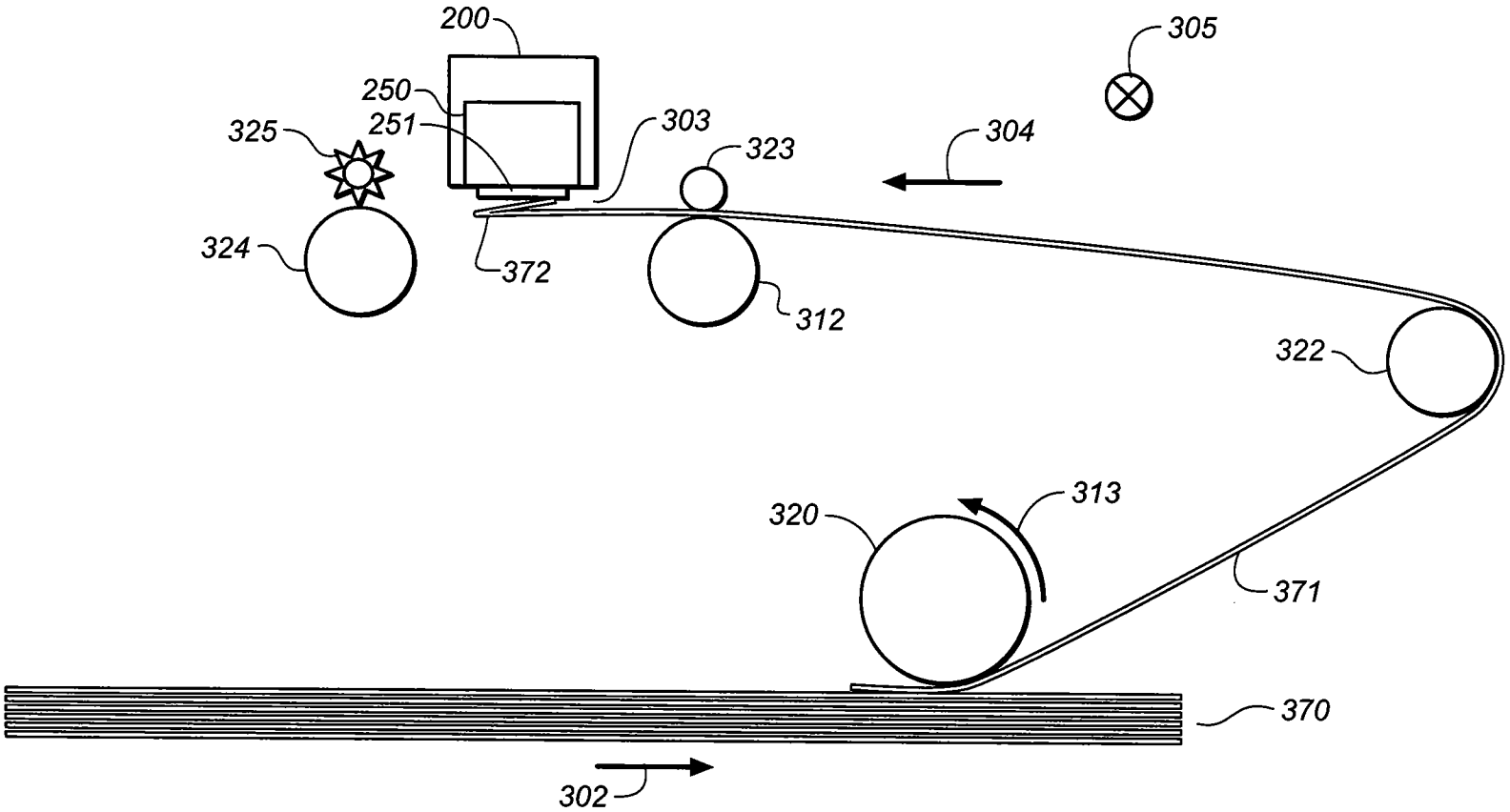
FIG. 5 is similar to FIG. 4, but for the case of a folded or dog-eared edge of paper striking the printhead face.

Because the nozzle face 112 of printhead die 251 is somewhat close to the sheet 371 of paper or other recording medium 20, in some undesirable circumstances, the sheet 371 can actually strike the nozzle face 112. This can occur, for example, if the paper becomes folded or dog-eared, as schematically shown by folded edge 372 in FIG. 5. Paper strikes can also occur if multiple sheets are inadvertently fed at the same time, especially if a resulting paper jam causes the paper to fold in accordion fashion. In some instances, paper strikes result in ink smears on the printed page. However, an even more serious result can occur if the paper strike damages the nozzle face 112. Some types of nozzle faces 112 are formed of fragile or brittle materials that can break or become distorted due to a paper strike such that future print quality is unacceptable and the printhead needs to be replaced.

Figure 6:
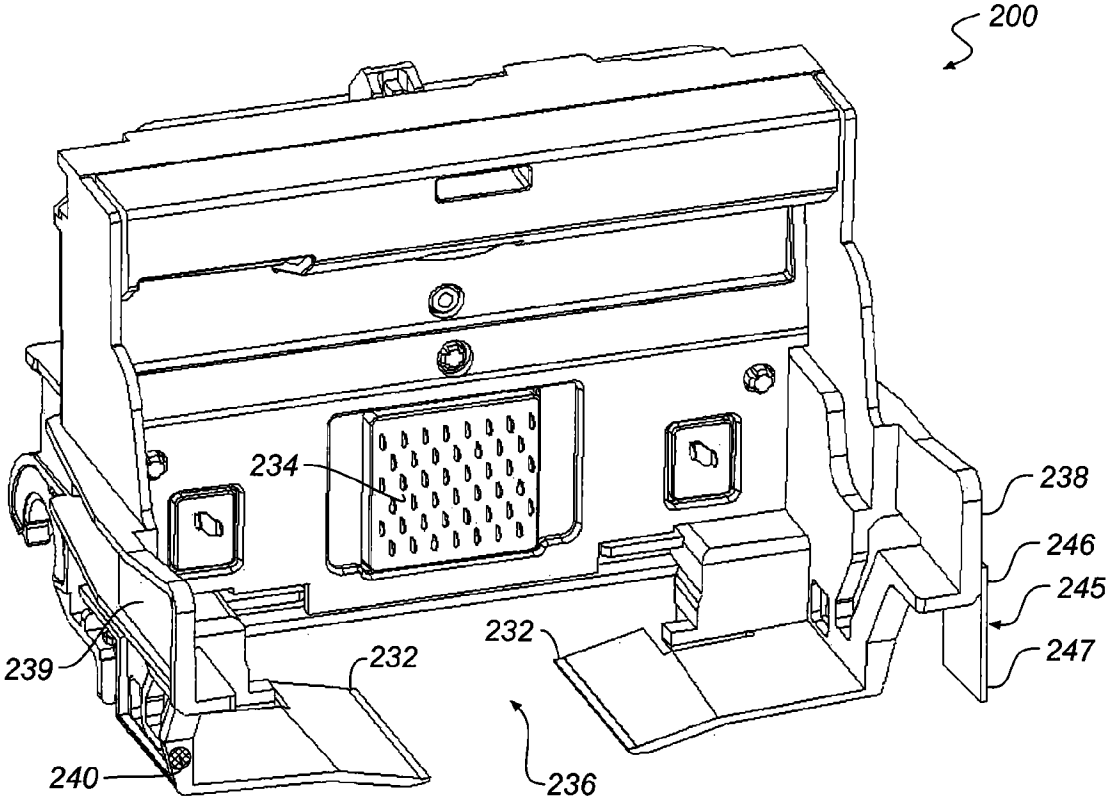
FIG. 6 is a top perspective of a carriage including two examples of sensors according to embodiments of the invention.

Embodiments of the present invention include one or more sensors for detecting whether a portion of the recording medium 20 is positioned to be in a collision path with the printhead face (e.g. nozzle face 112) when the portion of the recording medium 20 is advanced into the printing region 303. FIG. 6 shows a top perspective of the carriage 200 having two different exemplary types of sensors for detecting whether a portion of recording medium 20 is in a potential collision path with the printhead face 112. A microphone 240 is one example of a sensor that can be mounted on carriage 200 for sensing vibrations due to acoustical noise resulting from a collision between a portion of recording medium 20 and a portion of the carriage 200 that is upstream of the printhead face 112, as is described in more detail below relative to FIG. 7. A piezoelectric element 245 is another example of a sensor that can be mounted on carriage 200 for sensing vibrations due to impact resulting from a collision between a portion of recording medium 20 and a portion of piezoelectric element 245 that is upstream of the printhead face 112, as is described in more detail below relative to FIG. 8. In this example, piezoelectric element 245 is mounted such that a first end 246 is affixed to first side 238 of the carriage 200 and a second end 247 is cantilevered. Second end 247 is positioned approximately at a same level as the printhead face 112 (FIG. 8) when printhead 250 is installed in holding receptacle 236 with the printhead face 112 exposed between flaps 232. Typically only one of the two types of sensors (microphone 240 or piezoelectric element 245) would be mounted on carriage 200. However, for piezoelectric element 245 there could be a first one mounted on the first side 238 of carriage 200 as shown in FIG. 6 and a second one (not shown) mounted on the opposite side 239 of carriage 200.

Figure 7:
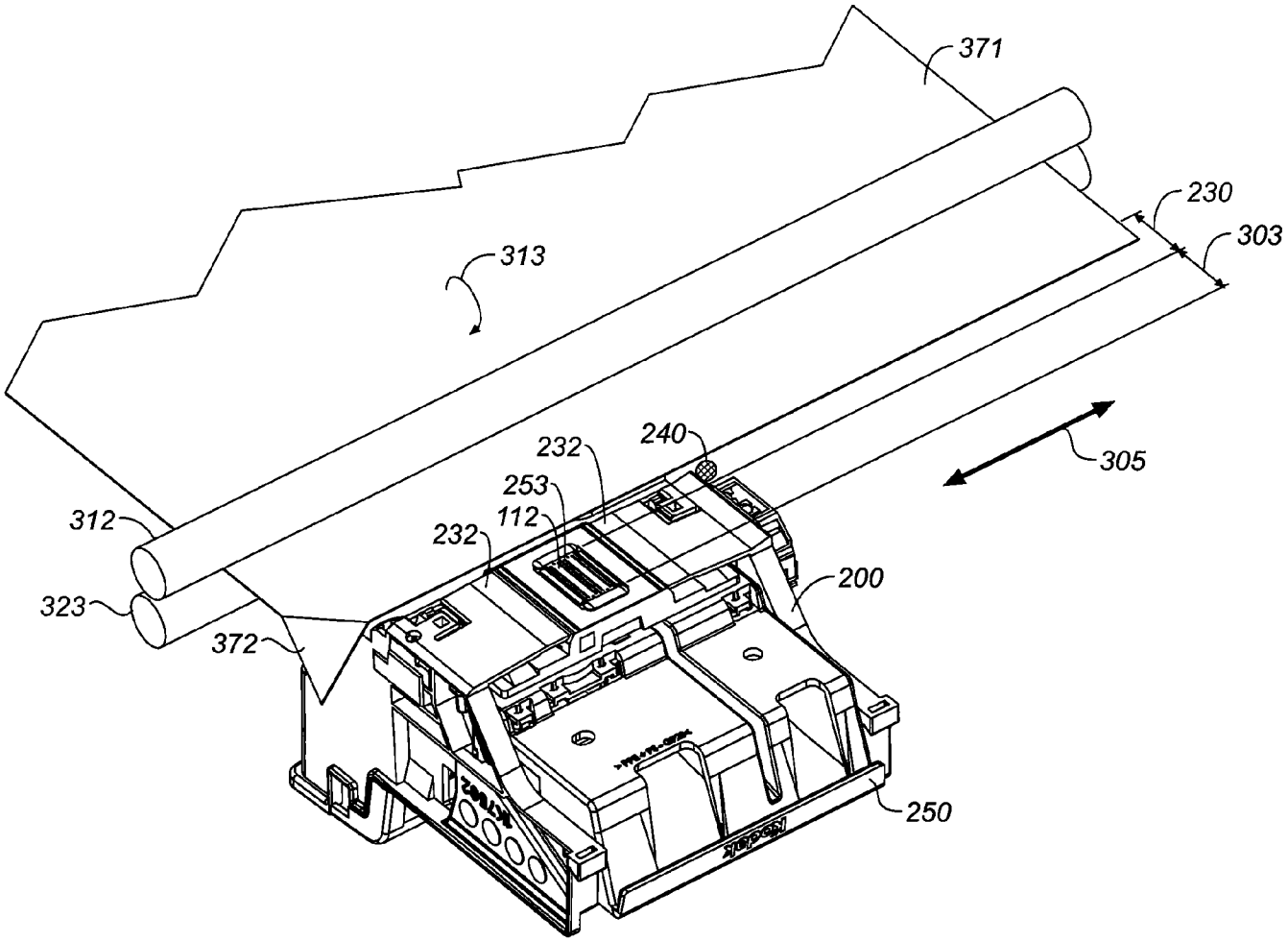
FIG. 7 is a bottom perspective of the carriage and printhead with a microphone for detecting collisions with dog-eared recording medium.

FIG. 7 shows a bottom perspective of the carriage 200 and printhead 250 relative to a dog-eared sheet 371 of recording medium 20 having a folded edge 372. Also shown are portions of feed roller 312 and idler roller 323. Printing region 303 is in line with printhead face 112 that includes nozzle arrays 253. Printhead face 112 is positioned between flaps 232 of the carriage 200. Upstream from printing region 303 is collision sensing region 230 of the carriage 200. At least one edge or other feature (not shown) of the carriage 200 is located in collision sensing region 230 substantially at a same level as printhead face 112. As a result if the folded edge 372 is determined to strike the printhead 250 in collision sensing region 230, then advancing the sheet 371 into the printing region 303 would cause folded edge 372 to also strike the printhead face 112. The advantage of this is that no fragile items are located in collision sensing region 230 of carriage 200. Thus, for example, as long as folded edge 372 of sheet 371 is advanced into collision sensing region 230, but is still upstream of printing region 303, carriage 200 can be moved along carriage scan direction 305 and cause a collision between folded edge 372 and collision sensing region 230 without doing damage to fragile items such as printhead face 112. A sensor such as microphone 240 can be mounted on carriage 200 to detect an acoustical signal corresponding to a collision between folded edge 372 and the carriage sensing region 230. In the example of FIG. 7, microphone 240 is shown as located in collision sensing region 230. The position of microphone 240 is not critical and it could be located elsewhere, as long as it can detect an acoustical signal corresponding to a collision between a protruding portion of sheet 371 and collision sensing region 230.

Figure 8:
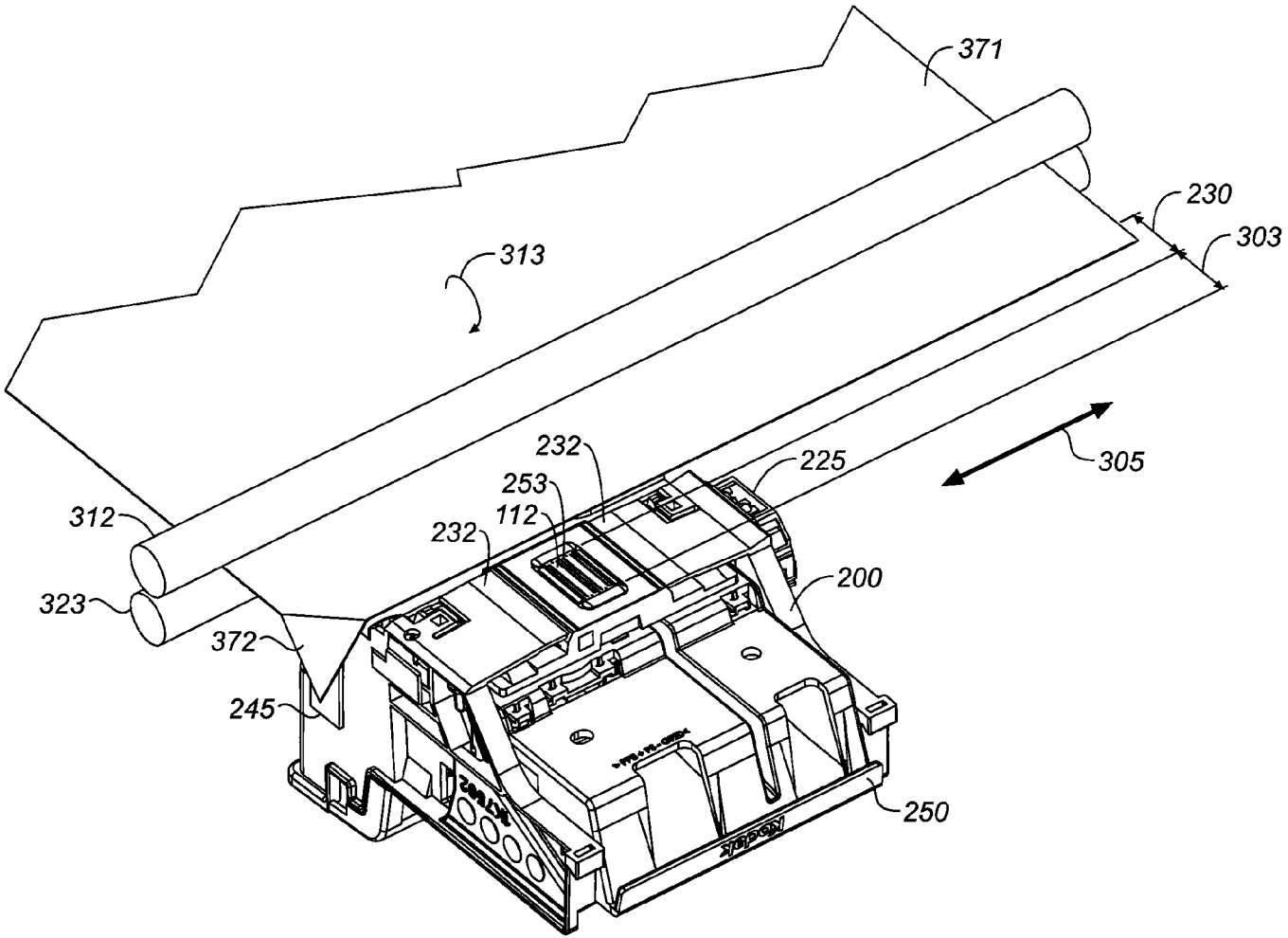
FIG. 8 is a. bottom perspective of the carriage and printhead with a piezoelectric element for detecting collisions with dog-eared recording medium.

FIG. 8 is similar to FIG. 7, but in the example of FIG. 8, the piezoelectric element 245 is located in collision sensing region 230. As described above relative to FIG. 6, in some embodiments piezoelectric element 245 has a cantilevered second end 247 that is positioned to collide with a protruding portion of sheet 371 of recording medium 20 while the protruding portion is still upstream of printhead face 112. In the example of FIG. 8, piezoelectric element 245 is a piezoelectric film disposed substantially along a first plane (a vertical plane in FIG. 8), and printhead face 112 is disposed along a second plane (a horizontal plane in FIG. 8) that is substantially perpendicular to first plane. If second end 247 collides with a protruding portion such as folded edge 372, it has been found that a signal having an amplitude of more than 1 volt can be produced.

FIG. 8 also shows an optical sensor, also called a carriage sensor 225 in U.S. Pat. No. 7,800,089, which is incorporated herein by reference in its entirety. Carriage sensor 225 is mounted on carriage 200 and includes both a light emitter that is directed toward printing region 303, and a photosensor that is configured to receive light reflected from a sheet 371 of recording medium 20. The field of view of a typical carriage sensor 225 is within printing region 303 because one of the functions of carriage sensor 225 is to look at marks printed on sheet 371. However, if the field of view of a carriage-mounted optical sensor similar to carriage sensor 225 were moved to a position upstream of printing region 303 (the position is not shown in FIG. 8 but corresponds to a position within collision sensing region 230), for example by positioning such an optical sensor upstream of carriage sensor 225, such an optical sensor could detect portions of sheet 371 that would be potentially on a collision path with printhead face 112. For example, the optical reflectance of sheet 371 upstream of printhead face 112 could be monitored for a significant change in reflected light signal that would result from a folded edge or other types of protruding portions of sheet 371. In some embodiments, the optical sensor could be used to sense a distance to sheet 371 and a significant decrease in distance could be interpreted as a portion of sheet 371 that is on a potential collision path with printhead face 112.

A different configuration of optical sensor is shown in FIG. 3. A light emitter 220 is located by platen 301 near the left end of (and slightly upstream of) printing region 303. A photosensor 222 is located by platen 301 near the right end of (and slightly upstream of) printing region 303. Light emitter 220 is configured to emit light along a direction, such as carriage scan direction 305, which is parallel to a plane defined by printing region 303. Photosensor 222 is displaced from light emitter 220 along the direction of emitted light. When sheet 371 has been advanced to a location just upstream of printing region 303, if sheet 371 is not in a potential collision path with printhead face 112, the light received by photosensor 222 from light emitter 220 will not be interrupted. However, if there is a protruding portion of sheet 371 that is on a potential collision path with printhead face 112, some of the light from light emitter 220 will be blocked and the signal level that is detected by photosensor 222 will decrease.

Whether the sensor for detecting potential collisions with printhead face 112 is a microphone 240, a piezoelectric element 245, a carriage mounted optical sensor (similar to sensor 225 as discussed above), or an optical sensor 220 and 222 located by platen 301, controller 14 (FIG. 1) is configured to receive a signal from the sensor and to interpret whether the signal corresponds to a potential collision with the printhead face 112. If the controller 14 interprets the signal as corresponding to a potential collision with printhead face 112, controller 14 can be configured to send a signal to a motor for rotating feed roller 312 in a reverse direction opposite forward direction 313 (FIGS. 7 and 8). For some types of protrusions of sheet 371, passing the paper in reverse at least partially into the nip between feed roller 312 and idler roller 323 can flatten out the protruding portion so that sheet 371 can subsequently be advanced into printing region 303 and printed on. Alternatively, if the controller 14 interprets the signal as corresponding to a potential collision with printhead face 112, controller 14 can be configured to send a user message, such as an audible alarm or an error message to alert the user that the sheet 371 of recording medium needs to be removed.

Having described the various parts of the printing system, a context has been provided for describing a method of operation. Recording medium, such as sheet 371 is advanced along a medium advance direction 304 toward printing region 303. A sensor is used to detect whether a portion of the recording medium 20 is positioned such that it would be in a collision path with the printhead face 112 if the recording medium 20 is advanced into the printing region 303. Typically the sensor would send signals to controller 14, where the signals would be processed and interpreted to indicate whether the signals correspond to a potential collision path. If it is detected that the recording medium 20 would not be in a collision path with the printhead face 112, the recording medium 20 would be advanced into printing region 303 and the desired image would be printed on the recording medium 20.

In some embodiments, if it is detected that the recording medium 20 would be in a collision path with the printhead face 112, the recording medium 20 would be moved along a direction opposite media advance direction 304, for example by sending a signal from controller 14 to a media advance motor to rotate feed roller 312 in a reverse direction to move the recording medium 20 away from printing region 303. Optionally, after the recording medium 20 has been moved along the direction opposite media advance direction 304, the controller 14 can send a signal to the media advance motor to rotate the feed roller in a forward direction so that the recording medium 20 is again advanced toward printing region 303. The sensor is again used to detect whether a portion of the recording medium 20 is positioned such that it would be on a potential collision path with the printhead face 112 if the recording medium 20 is advanced into printing region 303. If it is detected that the recording medium 20 now would not be in a collision path with printhead face 112, it can be advanced into the printing region 303 and the desired image can be printed on the recording medium 20.

In some embodiments, such as those where the printer includes a carriage 200 for moving the printhead 250 back and forth across printing region 303, if a potential collision with the printhead face 112 is detected, controller 14 can send a signal to carriage motor 380 to move the carriage 200 to a location where it and the printhead 250 are outside printing region 303. In other words, the printing face 112 would be moved beyond where the side edges of the recording medium 20 are located. Then the controller 14 can send a signal to the media advance motor to rotate the feed roller 312 in the forward direction 313 so that the recording medium 20 can be advanced to an output region, without printing on it. As a result, the recording medium 20 does not collide with the printhead face 112, and the recording medium 20 is discharged from the printer.

For embodiments where the printer includes a carriage 200 for moving the printhead 250 back and forth across the printing region and where a sensor is mounted on the carriage 200, detecting whether a portion of the recording medium 20 is positioned such that it would be in a collision path with the printhead face 112 can include moving the carriage 200 along a first direction and monitoring the sensor for a signal corresponding to a collision between a portion of the recording medium 20 and a portion of the carriage 200 that is upstream of the printing region 303. In order to clarify whether a signal actually corresponds to a collision, the carriage 200 can be moved in a direction to attempt to cause a confirmation collision between the carriage 200 and the portion of recording medium 20. For example, if the collision sensing region 230 includes two features (not shown) that protrude to a level that is substantially at the level of the printhead face 112, and the two features are a known distance apart, after the detection of the first signal (by microphone 240 for example) corresponding to a first of the two features, the carriage 200 can be moved by the known distance (relative to linear encoder 383) to see if the second feature will also collide with the portion of recording medium 20. Alternatively, if the carriage 200 includes two piezoelectric elements 245, one on a first side 238 of carriage 200 and one on an opposite side 239, as described above relative to FIG. 6, if collision impact is detected by the piezoelectric element 245 on the first side 238, the carriage 200 can continue to be moved along the same direction to see if collision impact is detected by the piezoelectric element 245 on the opposite side 239. Alternatively, if the carriage 200 includes only a single piezoelectric element 245 and a signal possibly corresponding to a collision is detected when the carriage 200 is moving in a first direction, the carriage direction can be reversed to see if a confirmation collision is detected by the same piezoelectric element 245.

In some embodiments, the sensor used for detecting potential collisions with the printhead face 112 can be used to perform other types of printer diagnostics as well. For example, for an embodiment where the sensor is configured to sense vibrations (such as microphone 240), the controller 14 can be configured to interpret whether the signal received from the sensor corresponds to a cause of vibration that is not associated with a potential collision with the printhead face 112. When the carriage 200 is parked at the maintenance station 330, for example, it is outside the printing zone 303, and not in a position to collide with a sheet 371 of recording medium 20. In such instances, microphone 240 can be used to monitor maintenance functions for proper operation. Microphone 240 can also be used to listen for motor stalling, bad bearings, a loose drive mechanism, or other such noises indicative of potential malfunction, so that the user or the manufacturer can be notified.

The invention has been described in detail with particular reference to certain preferred embodiments thereof, but it will be understood that variations and modifications can be effected within the spirit and scope of the invention. In particular, the invention has been described in detail for inkjet printheads in a carriage printer. More generally the invention can also be advantageous for other types of printheads which are moved relative to a recording medium. Such printheads include marking elements (analogous to the nozzles and drop forming mechanisms described above) for marking on the recording medium.

PARTS LIST

10 Inkjet printer system
12 Image data source
14 Controller
15 Image processing unit
16 Electrical pulse source
18 First fluid source
19 Second fluid source
20 Recording medium
100 Ink jet printhead
110 Ink jet printhead die
111 Die substrate
112 Nozzle face (printhead face)
120 First nozzle array
121 Nozzle in first nozzle array
122 Ink delivery pathway for first nozzle array
130 Second nozzle array
131 Nozzle in second nozzle array
132 Ink delivery pathway for second nozzle array
181 Droplet ejected from first nozzle array
182 Droplet ejected from second nozzle array
200 Carriage
220 Light emitter
222 Photosensor
225 Optical sensor (carriage sensor)
230 Collision sensing region
232 Flap(s)
234 Connector
236 Holding receptacle
238 First side
239 Opposite side
240 Microphone
245 Piezoelectric element
246 First end
247 Second end
250 Printhead
251 Printhead die
252 Mounting substrate
253 Nozzle array
254 Nozzle array direction
256 Encapsulant
257 Flex circuit
258 Connector board
262 Multichamber ink supply
264 Single chamber ink supply
300 Printer chassis
301 Platen
302 Paper load entry
303 Printing region
304 Media advance direction
305 Carriage scan direction
306 Right side of printer chassis
307 Left side of printer chassis
308 Front portion of printer chassis
309 Rear portion of printer chassis
310 Hole for paper advance motor drive gear
311 Feed roller gear
312 Feed roller
313 Forward rotation of feed roller
320 Pickup roller
322 Turn roller
323 Idler roller
324 Discharge roller
325 Star wheel
330 Maintenance station
332 Cap
334 Wiper
370 Stack of media
371 Top sheet
372 Folded edge
380 Carriage motor
382 Carriage rail
383 Linear encoder
384 Belt
390 Printer electronics board
392 Cable connectors

The invention claimed is:

1. A method of printing on a recording medium using a printhead having a printhead face that includes an array of marking elements, the method comprising:

advancing the recording medium along a medium advance direction toward a printing region;

detecting with a sensor whether a portion of the recording medium is positioned such that it would be in a collision path with the printhead face if the recording medium is advanced into the printing region; and advancing the recording medium into the printing region for printing if it is detected that the recording medium would not be in a collision path with the printhead face;

moving the recording medium along a direction opposite the media advance direction if it is detected that the recording medium would be in a collision path with the printhead face;

advancing the recording medium along the medium advance direction toward the printing region after moving the recording medium along the direction opposite the media advance direction;

again detecting whether a portion of the recording medium is positioned such that it would be in a collision path with the printhead face if the recording medium is advanced into the printing region; and advancing the recording medium into the printing region for printing if it is detected that the recording medium would not be in a collision path with the printhead face.

2. The method according to claim 1 further comprising:

moving the printhead away from the recording medium if it is detected that the recording medium would be in a collision path with the printhead face; and advancing the recording medium to an output region without printing on the recording medium.

3. The method according to claim 2 further comprising moving a carriage of the printhead back and forth across the printing region, wherein moving the printhead away from the recording medium includes moving the carriage to a location that is outside the printing region.

4. The method according to claim 1 further comprising moving a carriage of the printhead back and forth across the printing region and mounting the sensor on the carriage, wherein detecting whether a portion of the recording medium is positioned such that it would be in a collision path with the printhead face comprises:

moving the carriage along a first direction; and monitoring the sensor for a signal corresponding to a collision between a portion of the recording medium and a portion of the carriage that is upstream of the printing region.

5. The method according to claim 4 further comprising moving the carriage in a direction to attempt to cause a confirmation collision between the carriage and the portion of recording medium if a signal corresponding to a collision has been detected.

6. The method according to claim 5, wherein the direction to attempt to cause a confirmation collision is the same as the first direction.

7. The method according to claim 5, wherein the direction to attempt to cause a confirmation collision is opposite the first direction.

8. The method according to claim 1, wherein the sensor is an optical sensor.

9. The method according to claim 8, wherein detecting a change in a signal from an optical sensor includes detecting a change in an amount of light reflected from the recording medium.

10. The method according to claim 1 further comprising providing an audible alarm if it is detected that the recording medium would be in a collision path with the printhead face.

11. The method according to claim 1 further comprising providing an error message if it is detected that the recording medium would be in a collision path with the printhead face.

12. A method of printing on a recording medium using a printhead having a printhead face that includes an array of marking elements, the method comprising:

advancing the recording medium along a medium advance direction toward a printing region;

detecting with a sensor whether a portion of the recording medium is positioned such that it would be in a collision path with the printhead face if the recording medium is advanced into the printing region; and advancing the recording medium into the printing region for printing if it is detected that the recording medium would not be in a collision path with the printhead face; wherein detecting whether a portion of the recording medium is positioned such that it would be in a collision path with the printhead face further comprises:

sending signals from a sensor to a controller;

processing the signals; and using the controller to interpret whether the signals correspond to a potential collision path;

including a feed roller upstream of the printing region, and sending a signal from the controller to a media advance motor to rotate the feed roller in a reverse direction to move the recording medium away from the printing region if it is detected that the recording medium would be in a collision path with the printhead face;

sending a signal from the controller to the media advance motor to rotate the feed roller in a forward direction after moving the recording medium away from the printing region;

again detecting whether a portion of the recording medium is positioned such that it would be in a collision path with the printhead face if the recording medium is advanced into the printing region; and advancing the recording medium into the printing region for printing if it is detected that the recording medium would not be in a collision path with the printhead face.

13. The method according to claim 12 further comprising including a carriage for moving the printhead back and forth across the printing region, the method further comprising:

sending a signal from the controller to a carriage motor to move the carriage to a location that is outside the printing region if it is detected that the recording medium would be in a collision path with the printhead face; and sending a signal from the controller to a media advance motor to rotate the feed roller in a forward direction to advance the recording medium to an output region without printing on it.

14. The method according to claim 12 further comprising performing diagnostics on other portions of the printer using the signals sent from the sensor to the controller.

* * * * *